US005103520A

United States Patent [19]

Mazzo

[11] Patent Number: 5,103,520

[45] Date of Patent: Apr. 14, 1992

[54] MULTI-PURPOSE HAND TOOL

[76] Inventor: William L. Mazzo, 2600 U.S. 1 South, St. Augustine, Fla. 32484

[21] Appl. No.: 440,911

[22] Filed: Nov. 24, 1989

[51] Int. Cl.[5] ..... B25F 1/04

[52] U.S. Cl. ..... 7/104; 7/116; 7/143; 7/151; 294/51; 294/53.5

[58] Field of Search ..... 7/104, 114, 116, 143, 7/151, 170; 294/49, 51, 53.5; 172/375

[56] References Cited

U.S. PATENT DOCUMENTS

| | | | |
|---|---|---|---|
| 1,055,044 | 3/1913 | Hollander | 7/116 |
| 2,377,730 | 6/1945 | Vosbikian et al. | 7/116 |
| 3,074,752 | 1/1963 | Kirkel | 7/116 |
| 3,561,023 | 2/1971 | Shandel | 7/145 |
| 3,592,272 | 7/1971 | Perez | 172/375 |
| 4,549,611 | 10/1985 | Mills | 172/375 |
| 4,727,609 | 3/1988 | Smith, Jr. | 7/145 |

FOREIGN PATENT DOCUMENTS

| | | | |
|---|---|---|---|
| 332238 | 10/1958 | Switzerland | 7/145 |

*Primary Examiner*—Roscoe V. Parker

*Attorney, Agent, or Firm*—Charles A. McClure

[57] ABSTRACT

A multi-purpose tool, partly foldable, useful as a hammer/pick, probe/ruler, knife/saw, spade/trowel, and even as a bottle-opener. Various embodiments are characterized by degrees of folding to compact stowed form and of unfolding to particular use configurations.

6 Claims, 2 Drawing Sheets

FIG. 1
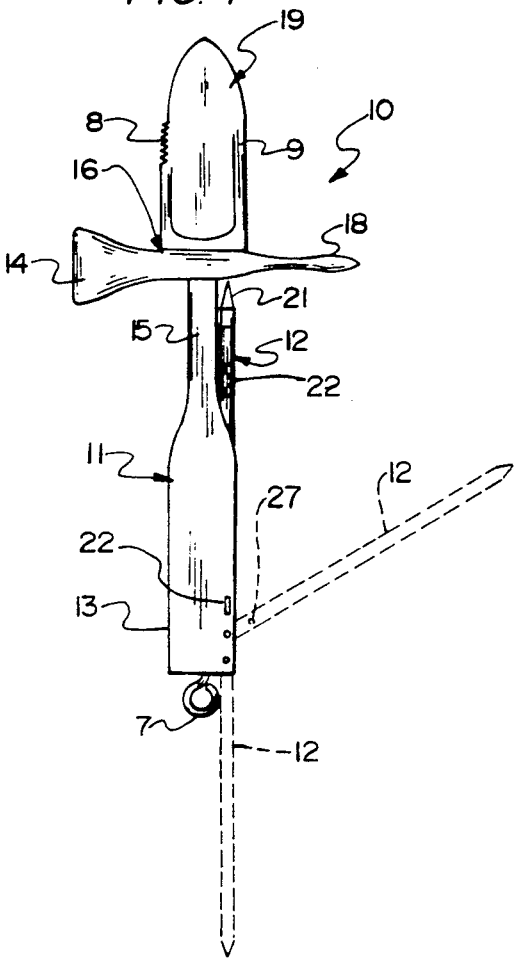
FIG. 2
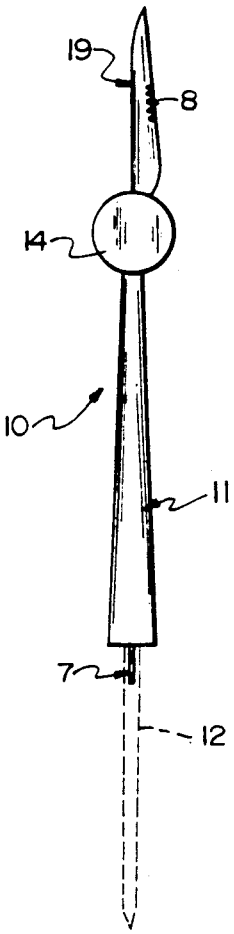
FIG. 3
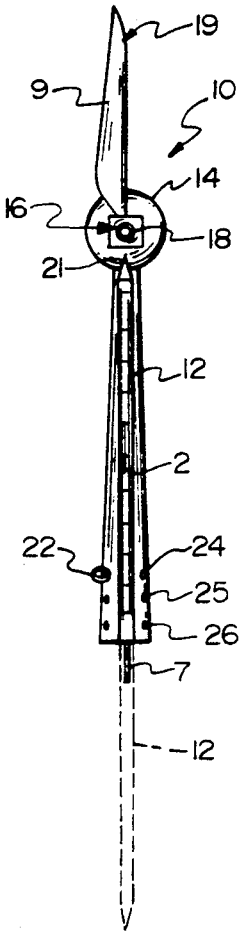
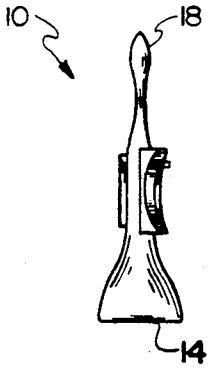
FIG. 4
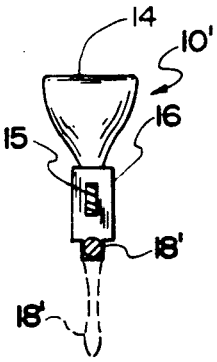
FIG. 5
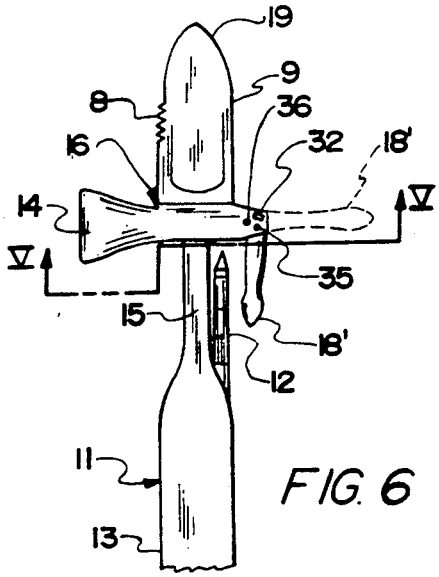
FIG. 6

MULTI-PURPOSE HAND TOOL

TECHNICAL FIELD

This invention relates to a multi-purpose hand tool, foldable to a greater or lesser extent, and adapted for use as a hammer/pick, probe/ruler, knife/saw, spade/-trowel, and even as a bottle-opener.

BACKGROUND OF THE INVENTION

Persons whose vocation involves more than casual poking around in the earth have special-purpose tools that they take to sites of interest in such roles as agriculturist, anthropologist, builder, digger, geologist, prospector, rescue worker, soldier, or surveyor. Persons who pursue similar activities casually by way of avocation, whether as a camper, backyard gardener, beachcomber, handyman, or the like, may lack such a well defined need or otherwise be unable to justify acquiring or carrying such specialized tools. However, both amateurs and professionals are well served on occasion by compact versatile tools, in place of a group of individual specialized ones, as is confirmed by the almost legendary Swiss army knife.

Waara in U.S. Pat. No. 2,884,278 discloses a Garden and Lawn Tool convertible between a hoe-rake and a shovel or trowel. Perez in U.S. Pat. No. 3,592,272 discloses a Multipurpose Garden Tool with its sides variously useful as a spade, axe or knife, draw-rake, trimmer, etc. Mills in U.S. Pat. No. 4,549,611 discloses a Multi-Purpose Hand Tool including a hoelike gutter-cleaning end on a handle usable as a depth probe and suggests other uses for it, as well as summarizing ten prior patents. Although those inventions were meritorious, they do not begin to approach the compactness and versatility of mine.

SUMMARY OF THE INVENTION

A primary object of the present invention is to provide a tool useful in digging, impacting, probing, severing, and similar uses.

Another object is to provide a tool helpful to prospectors for minerals or to persons seeking other underground objects.

A further object is to enhance safety in a multi-purpose tool.

Yet another object is to make such a tool compactly foldable.

A still further object is to do the foregoing economically.

In general, the objects of the present invention are attained in a multi-purpose hand tool having two or more of the functions of digging, impacting, probing, and severing. More particularly, this tool has a handle that carries such functional parts as hammer/pick, probe/ruler, knife/saw, spade/trowel, and bottle-opener.

Other objects of the present invention, together with means and methods for attaining the various objects, will be apparent from the following description and accompanying diagrams of preferred embodiments, which are presented by way of example rather than limitation.

SUMMARY OF THE DRAWINGS

FIG. 1 is a side elevation of a first embodiment of this invention, with a folding part shown deployed (unfolded) in dashed lines;

FIG. 2 is a front end elevation of the tool of FIG. 1;

FIG. 3 is a rear elevation of the tool of the preceding views;

FIG. 4 is a top plan of the tool of FIGS. 1 to 3; and

FIG. 5 is a bottom sectional plan view of another embodiment of the tool of this invention, in which a previously fixed part is now foldable and is shown both stored (solid lines) and deployed (dashed lines) taken at V—V on FIG. 6; lines)

FIG. 6 is a side elevation of the embodiment of FIG. 5.

DESCRIPTION OF THE INVENTION

Figure 7:
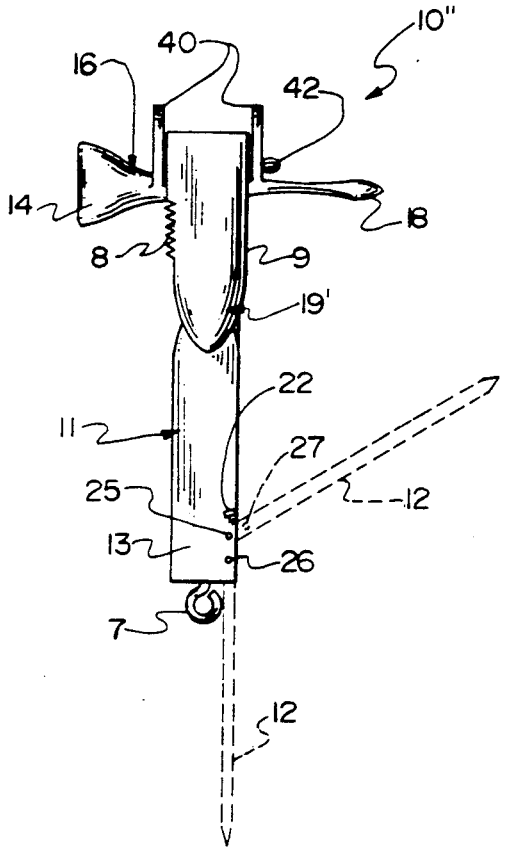
FIG. 7 is a side elevation of yet another embodiment of the tool of this invention, in which another previously fixed part is now foldable and is shown stored.

Multi-purpose tool 10 is shown from its left side in FIG. 1, front in FIG. 2, rear in FIG. 3, and top in FIG. 4. It features digging, impacting, and probing means. Longitudinal portion 11, having handle means with grip part 13 at its bottom end and adjacent haft part 15 carrying digging means in line therewith in the form of trowel-like blade 19 at its upper free end. Front edge 8 of the blade is serrated as a saw, and rear edge 9 is sharpened as a knife. The handle also carries toolpiece 16, with impact means both fore and aft, hammer head 14 protruding at the tool front (left in FIG. 1) and pick head 18 with pointed end at the rear (right in FIG. 1). Hookeye 7 at the base of the handle enables the tool to be hung up.

Probe 12, with ruler indentations or marks 22, is shown (solid lines) stowed along the rear edge of the haft and partly concealed (FIG. 1) along the rear edge of the grip (FIG. 3), which is grooved. The probe has pointed free end 21 and is mounted at its other end on pivot pin 25 through the handle. It is retained in position by pin 22 through opening 24 (FIG. 3) in the handle and alignable opening 27 in the probe itself. In the absence of the retaining pin, the probe can swing through intermediate positions (e.g., oblique dashed lines, FIG. 1) to deployed position (vertical dashed lines, FIGS. 1, 2, 3) where a retaining pin in opening 26 aligned with the other openings in the grip will hold the probe in fully deployed position.

FIGS. 5 and 6 show, in respective bottom sectional elevation just below the toolpiece and left side elevation (as in FIG. 1), modified embodiment 10' of the tool of this invention featuring a stowable pick 18'—shown stowed in solid lines and alternatively deployed in dashed lines. This pick is mounted on pivot 35 in a recess in the rear of the toolpiece body much as the probe is mounted in the recess in the rear of the handle. Retaining pin 32 is placed as shown for the stowed position but is removed and reinserted in opening 36 to hold the pick in the deployed position.

Figure 8:
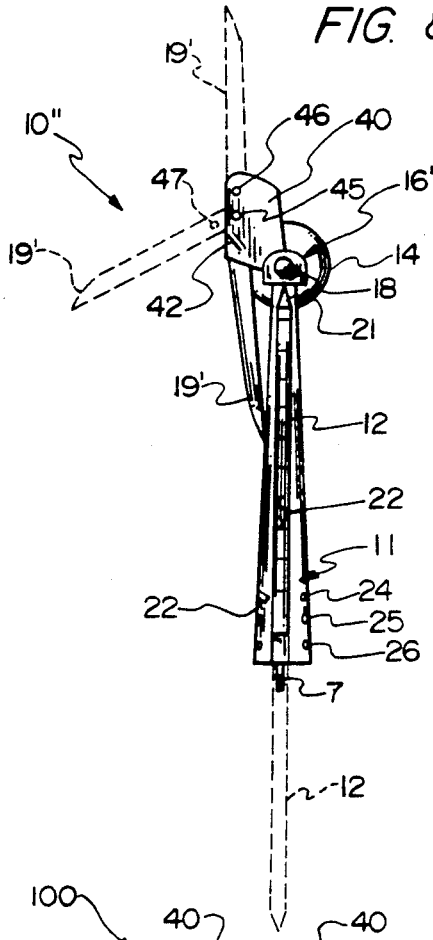
FIG. 8 is a rear elevation of the embodiment of FIG. 7 with the newly foldable part shown both stored (solid lines) and deployed (dashed lines)
Figure 9:
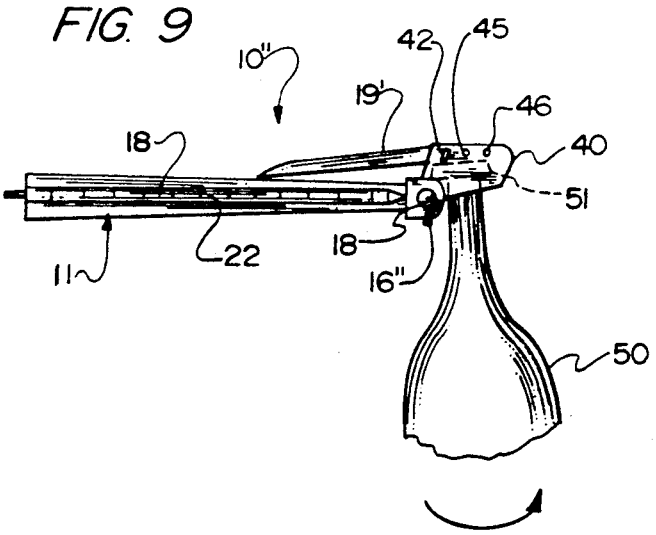
FIG. 9 is a fragmentary side elevation of the embodiment of FIGS. 7 and 8, showing use thereof as a bottle cap opener.

FIGS. 7, 8, and 9 show another modified embodiment 10'' of the tool of this invention from the left side, rear, and fragmentarily from the rear, respectively. FIG. 9 shows not only a different orientation from that of FIG. 8 but also a specific use.

This embodiment differs from the first embodiment in having modified blade 19' foldable to stowed position. Toolpiece 16' is modified by clevis 40 upstanding therefrom and carrying blade 19' on pivot 45. Also in the clevis are openings 46 above the pivot to receive a retainer pin when the blade deployed (dashed lines in FIG. 6) and a like opening below the pivot with retainer pin 42 in it and through the retainer bore in the blade, in the stored position (solid lines) shown.

FIG. 9 shows tool embodiment 10'' fragmentarily from the rear in position such that the top of upright bottle 50 with cap 5! is inserted between the wings of clevis 40 with an edge of its cap 51 in between the pivoted end of blade 19' and the body of toolpiece 16'. Then, moving the bottle in the arcuate direction shown by an arrow will remove the cap from the bottle, as will be readily understood.

Figure 10:
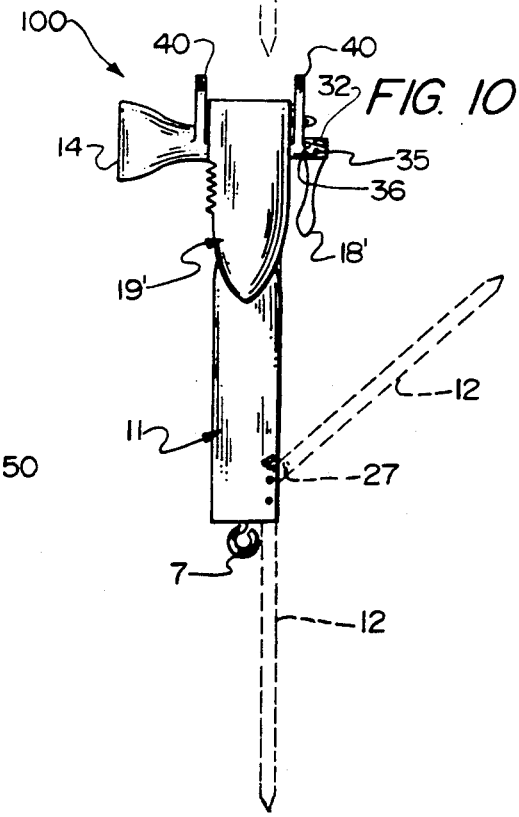
FIG. 10 is a fragmentary side elevation of a further embodiment of the tool of this invention, combining the various folding parts of the preceding embodiments into a single tool.

FIG. 10 shows further embodiment 100 of the tool of this invention from the left side (similar to FIG. 7) combining all of the various folding parts of the preceding embodiments into a single tool. Each such part is shown deployed in dashed lines and stored in solid lines. With the diverse parts folded into their respective stored positions this versatile tool is very convenient to carry, as in a back pack, slung on a belt, or in a tool kit, for example.

This invention does not require any unusual materials or manufacturing techniques. For light weight with suitable strength, the tool may be composed of metal or a durable plastic, but preferably is made of a mix of metal and/or plastic and/or wood. The digging, impacting, and probing parts are conveniently steel or other metal, the hollow or solid handle being metal, plastic, or wood. Smaller versions may be made as toys, and larger ones for more regular use.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

The claimed invention is:

1. Multi-purpose hand tool comprising substantially straight handle means having a haft and a grip portion and having digging means pivotally mounted on the haft portion in deployed position and alternatively in stowed position, clevis means protruding from the haft portion, flanking the digging means, and carrying a pivot pin pivotally mounting the digging means, the digging means having a positioning bore transversely therethrough substantially parallel to the pivot pin, and the clevis means having pairs of aligned bores therethrough parallel to and flanking the pivot pin forward and aft thereof, and a locking pin insertable through either pair of bores, wherein the digging means is thereby adapted to align with one of the clevis bore pairs in normally deployed position and to align with the other of the clevis bore pairs in alternative stowed position and be locked in the selected position by insertion of the locking pin therethrough.

2. Multi-purpose hand tool according to claim 1, including a locking pin fitting through the positioning bore and through either of the bores in the clevis means to secure the blade in deployed or stowed position as desired.

3. Multi-purpose hand tool according to claim 1, including impact means normally protruding substantially perpendicular to the haft portion and comprising a hammer head protruding in a forward direction, and a pick head protruding in an aft direction therefrom.

4. Multi-purpose hand tool according to claim 3, wherein at least one such head is pivotally mounted relative to the handle means and thereby is alternatively foldable from its normally protruding deployed position into a stowed position against and partly overlapping the handle means.

5. Multi-purpose hand tool according to claim 4, including locking means adapted to lock such pivotal head in its normally deployed position, and locking means adapted to lock such pivotal head in its alternative stowed position.

6. Multi-purpose folding hand tool comprising handle means at one end thereof digging means including a trowel blade having a base, mounted on the handle means and convertible between deployed and stowed positions, adapted inn stowed position to function as a bottle opener by reason of spacing of the base of the trowel blade from the handle means sufficiently to enable the top of a bottle cap too be engaged by the blade base and the rim of the cap to be engaged by the handle means as a fulcrum, whereby pivoting of the bottle about such fulcrum is effective too pry off the cap.

* * * * *

UNITED STATES PATENT AND TRADEMARK OFFICE

CERTIFICATE OF CORRECTION

PATENT NO. : 5,103,520
DATED : April 14, 1992
INVENTOR(S) : William L. Mazzo

It is certified that error appears in the above-indentified patent and that said Letters Patent is hereby corrected as shown below:

On the Title page, item [76], inventor's ZIP Code should be --32084-- instead of "32484"--
Column 3, line 14, "5!" should be -- 51 --;
Column 4, line 42, between "means" and "at" insert -- and --;
Column 4, line 45 change 'inn" to -- in --;
Column 4, line 48 and 51 change "too" to -- to --.

Signed and Sealed this

Fifteenth Day of June, 1993

*Attest:*

*Attesting Officer*

Michael K. Kirk

MICHAEL K. KIRK

*Acting Commissioner of Patents and Trademarks*